United States Patent [19]

Wilson

[11] 4,214,710

[45] Jul. 29, 1980

[54] FROTH FLOTATION OF ZINC SULFIDE

[75] Inventor: Martin Wilson, Irvine, Calif.

[73] Assignee: United States Borax & Chemical Corporation, Los Angeles, Calif.

[21] Appl. No.: 953,140

[22] Filed: Oct. 20, 1978

[51] Int. Cl.[2] ..... B02C 17/00

[52] U.S. Cl. ..... 241/24; 209/166; 241/27

[58] Field of Search ..... 209/166, 167; 252/61; 241/20, 24, 27

[56] References Cited

U.S. PATENT DOCUMENTS

| | | | |
|---|---|---|---|
| 1,055,495 | 3/1913 | Schick | 209/166 |
| 2,407,651 | 9/1946 | Clemmer | 209/166 |
| 3,235,077 | 2/1966 | McGarry | 209/166 |
| 3,361,257 | 1/1968 | Haseman | 209/166 |
| 3,936,294 | 2/1976 | Childress | 209/166 X |
| 4,043,455 | 8/1977 | Ground | 209/167 |

FOREIGN PATENT DOCUMENTS

| | | | |
|---|---|---|---|
| 495948 | 9/1953 | Canada | 209/166 |
| 897388 | 11/1953 | Fed. Rep. of Germany | 209/166 |

*Primary Examiner*—Robert Halper

*Attorney, Agent, or Firm*—James R. Thornton

[57] ABSTRACT

Zinc sulfide is concentrated by a froth flotation process using a substituted benzotrifluoride compound as depressant for calcium fluoride. The benzotrifluoride compounds are substituted by hydrophilic groups such as hydroxy, carboxylic acid and amino.

12 Claims, No Drawings

FROTH FLOTATION OF ZINC SULFIDE

SUMMARY OF THE INVENTION

This invention relates to the purification of zinc sulfide by a froth flotation procedure and especially relates to the removal of substantially all calcium fluoride contaminant in zinc sulfide concentrates.

RELATED APPLICATION

Wilson application Ser. No. 805,778 filed June 13, 1977, now U.S. Pat No. 4,136,019 describes and claims the froth flotation of non-sulfide ores such as fluorspar and barite in which an organic $CF_3$-containing compound is used as a depressant for interfering calcium ions.

BACKGROUND OF THE INVENTION

Fluorspar ores often contain zinc sulfide and the fluorspar and sulfides are separated by a froth flotation procedure in which the sulfides are obtained as a flotation concentrate. This concentrate, which may also contain pyrite, is then submitted to a further forth flotation procedure in order to separate the zinc sulfide from the iron sulfide since the zinc values may be sold to a zinc smelter for ultimate conversion to zinc metal. However, a small amount of calcium fluoride is usually carried over in the concentrate and can make the zinc sulfide less desirable to the zinc smelter because of the resultant interfering fluoride. Therefore, it is desirable to remove as much calcium fluoride from the zinc concentrate as possible, thereby producing a desirable product which is readily accepted by zinc smelters.

DESCRIPTION OF THE INVENTION

The present invention provides an improved process for removing undesirable calcium fluoride contaminant from zinc sulfide by use of a froth flotation procedure. According to the present process, an effective amount of a depressant for the calcium fluoride is added to the flotation feed prior to submitting the feed to froth flotation.

The depressant is a benzotrifluoride compound having one or more hydrophilic substituents, such as the hydroxy, amino and carboxylic acid groups, on the benzene ring. Examples of such compounds include the mono-, di- and tri-hydroxy, amino and carboxylic acid substituted benzotrifluorides. The substituents may be ortho, meta or para to the $CF_3$ group. Typical examples include $\alpha,\alpha,\alpha$-trifluorotoluidines, trifluoromethylbenzoic acids and hydroxybenzotrifluorides. The hydroxybenzotrifluorides are presently preferred.

Suitable effective concentrations of the substituted benzotrifluoride reagent range from about 0.01 to about 0.8 lb. of reagent per ton of flotation feed; preferably, from about 0.1 to 0.4 lb. is used.

The froth flotation takes place in the presence of a collector reagent for the zinc sulfide such as the dithiophosphate and xanthate compounds well-known to the art. See, for example, U.S. Pat. No. 3,086,653 which describes the use of salts of dithiophosphate esters, such as the dialkyl esters, as flotation promotors. Such compounds are commercially available under the name Aerofloat, and include the sodium salts of the diethyl-, di-sec.butyl-, diisopropyl- and dimethylamyl dithiophosphates. The xanthates are also well-known collector reagents for sulfides, especially the ethyl-, propyl- and amyl xanthates.

Since the zinc sulfide can also contain a small amount of pyrite as a contaminant, a pyrite depressant such as sodium cyanide may also be used if necessary. Other well-known reagents such as activators, pH modifiers, and frothing agents, may also be used.

In practicing the present invention, a sulfide flotation concentrate is obtained in the conventional manner from a fluorspar concentrate which contains calcium fluoride, zinc sulfide and usually barite and iron sulfide. The rougher sulfide concentrate containing zinc sulfide and iron sulfide is reground in a ball mill to about −325 mesh and the slurry conditioned with a zinc sulfide collector reagent such as the dithiophosphates or xanthates and submitted to a conventional froth flotation. The resultant concentrate is preferably reground, the pH adjusted to about 10 with lime, the substituted benzotrifluoride depressant added and the material again subjected to a cleaner flotation procedure. The purified zinc sulfide is collected as a concentrate and, if necessary, submitted to additional cleaner flotations for further purification.

Preferably, a major amount of the sulfide concentrate is ground to −325, with best results obtained when at least 75% of the flotation feed is −325 mesh, with at least 90% being most preferred. Sodium silicate, a well-known slime depressant, can be added during grinding.

The following examples illustrate the process of the present invention.

EXAMPLES 1-8

100 g. of zinc sulfide concentrate from a rougher flotation containing about 47% zinc and 5% calcium fluoride was slurried with 90 ml. of water (7 gr. hardness), 5 ml. of a 5% solution of sodium carbonate, 2 ml. of 5% copper sulfate as a zinc activator, 2.5 ml. of a 1% solution of sodium diisopropyl dithiophosphate, and the mixture reground in a ball mill for a period of 5 or 10 minutes. The reground concentrate was then washed out of the ball mill, settled, decanted and the settled solids were transferred to a 1500 ml. Denver flotation cell with a stirrer speed of between 900 and 1200 rpm. The pH was adjusted to about 10 with a 5% sodium carbonate solution and a small amount of Dowfroth frothing agent added to the cell. Various amounts of ortho-hydroxybenzotrifluoride were also added, as noted in the following Table. The resultant flotation concentrates were refloated twice, collected and analyzed and the following results obtained:

TABLE

| Example | Screen Size −325 mesh (%) | Regrind Time (min.) | Depressant (lb./ton) | Concentrate % $CaF_2$ |
|---|---|---|---|---|
| 1 | 32 | 0 | 0 | 1.3 |
| 2 | 32 | 0 | 0.15 | 0.8 |
| 3 | 32 | 0 | 0.25 | 0.9 |
| 4 | 32 | 0 | 0.35 | 0.75 |
| 5 | 62 | 5 | 0 | 1.3 |
| 6 | 62 | 5 | 0.20 | 0.53 |
| 7 | 89 | 10 | 0 | 0.2 |
| 8 | 89 | 10 | 0.20 | 0.11 |

In examples 1 through 4, in which the concentrate had not be reground, it will be noted that a higher amount of calcium fluoride remained in the zinc sulfide concentrate. Thus, it is apparent that a combination of regrinding to obtain a higher content of −325 mesh material, as well as the use of the substituted benzotrifluoride depressant, can reduce the calcium fluoride contaminant to a low level, approaching 0%.

Various changes and modifications of the invention can be made, and, to the extent that such variations incorporate the spirit of the invention, they are intended to be included within the scope of the appended claims.

What is claimed is:

1. The process for selectively depressing calcium fluoride in the froth flotation of zinc sulfide which comprises effecting said froth flotation in the presence of an effective amount of collector for zinc sulfide and an effective amount of a substituted benzotrifluoride depressant in which said substituent is selected from the group consisting of hydroxy, amino and carboxylic acid.

2. The process according to claim 1 in which said substituted benzotrifluoride is o-hydroxybenzotrifluoride.

3. The process according to claim 1 in which said collector for zinc sulfide is an alkali metal salt of a dialkyl dithiophosphate ester.

4. The process according to claim 1 in which about 0.1 to 0.4 pound of said depressant is added per ton of said flotation feed.

5. The process according to claim 1 in which said zinc sulfide is ground to about −325 mesh prior to said froth flotation.

6. The process according to claim 5 in which at least about 75% of said zinc sulfide is −325 mesh.

7. In the method of purification of zinc sulfide by froth flotation, the improvement which consists of carrying out said froth flotation in the presence of an effective amount of a collector for zinc sulfide and a substituted benzotrifluoride depressant, thereby depressing calcium fluoride impurities, said benzotrifluoride substituent being selected from the group consisting of hydroxy, amino and carboxylic acid.

8. The process according to claim 7 in which said depressant is o-hydroxybenzotrifluoride.

9. The process according to claim 7 in which about 0.1 to 0.4 pound of said depressant per ton of flotation feed is present.

10. The process according to claim 7 in which said zinc sulfide is ground to about −325 mesh prior to said froth flotation.

11. The process according to claim 7 in which said froth flotation is in the presence of an effective amount of sodium diisopropyl dithiophosphate collector reagent.

12. The process according to claim 11 in which about 0.1 to 0.4 pound of o-hydroxybenzotrifluoride depressant is present per ton of flotation feed.

* * * * *